US005135018A

United States Patent [19]

Anderson

[11] Patent Number: 5,135,018

[45] Date of Patent: Aug. 4, 1992

[54] PORTABLE UMBRELLA SHELTER

[76] Inventor: Dennis L. Anderson, 2544 N. 7th St., Phoenix, Ariz. 85006

[21] Appl. No.: 678,662

[22] Filed: Apr. 1, 1991

Related U.S. Application Data

[62] Division of Ser. No. 405,200, Sep. 11, 1989.

[51] Int. Cl.[5] ..... E04H 15/26

[52] U.S. Cl. ..... 135/99; 135/114; 135/904

[58] Field of Search ..... 135/904, 87, 99, 98, 135/114

[56] References Cited

U.S. PATENT DOCUMENTS

| | | | |
|---|---|---|---|
| 988,400 | 4/1911 | Stonebridge | 135/904 |
| 1,185,642 | 6/1916 | Emerson | 135/904 |
| 1,219,905 | 3/1917 | Barringer | 135/904 |
| 1,449,689 | 3/1923 | Muehleisen | 135/99 |
| 2,183,833 | 12/1939 | Farhar | 135/904 |
| 4,971,090 | 11/1990 | Uhl | 135/99 |

FOREIGN PATENT DOCUMENTS

| | | | |
|---|---|---|---|
| 1506052 | 9/1989 | U.S.S.R. | 135/99 |

*Primary Examiner*—Henry E. Raduazo

*Attorney, Agent, or Firm*—Don J. Flickinger; Jordan M. Meschkow; Lowell W. Gresham

[57] ABSTRACT

A portable collapsible shelter for use at sporting events and the like includes a rectangular flexible enclosure having a viewing window in one wall thereof. The enclosure is supported by a frame which includes a central, hollow, telescoping support pole. The telescoping support pole permits the height of the shelter to be adjusted. When not in use, the entire shelter may be transported and stored within the telescoping support pole. In a second embodiment of the invention, the frame includes a vertical support pole and a plurality of ribs hinged for movement from a collapsed position alongside the pole to an extended position nearly perpendicular to the pole. The enclosure is left in place over the frame when the ribs are collapsed, and folded into a compact storage packet which is secured with a fastening band.

11 Claims, 3 Drawing Sheets

FIG. 1
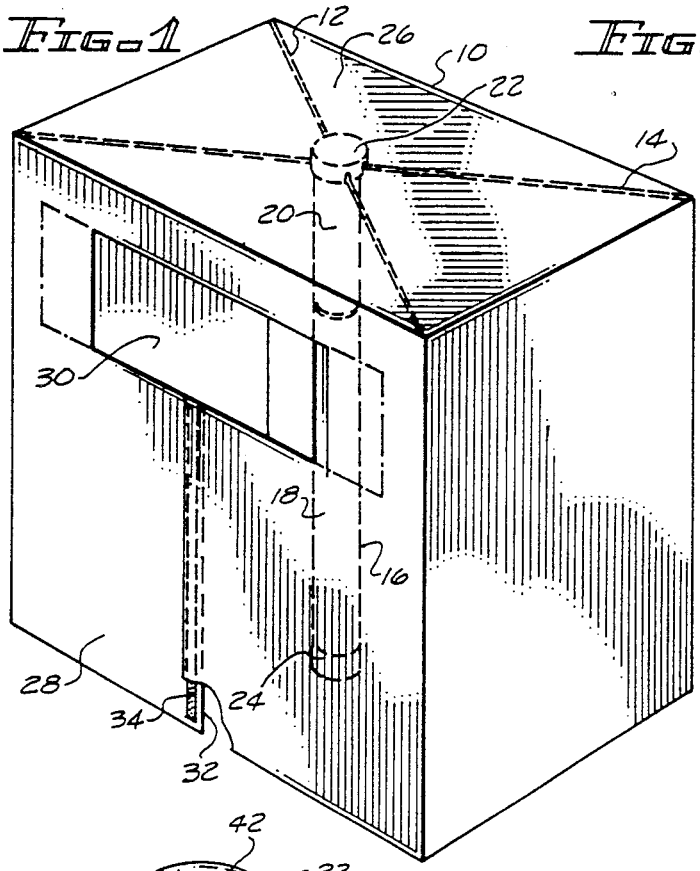
FIG. 2
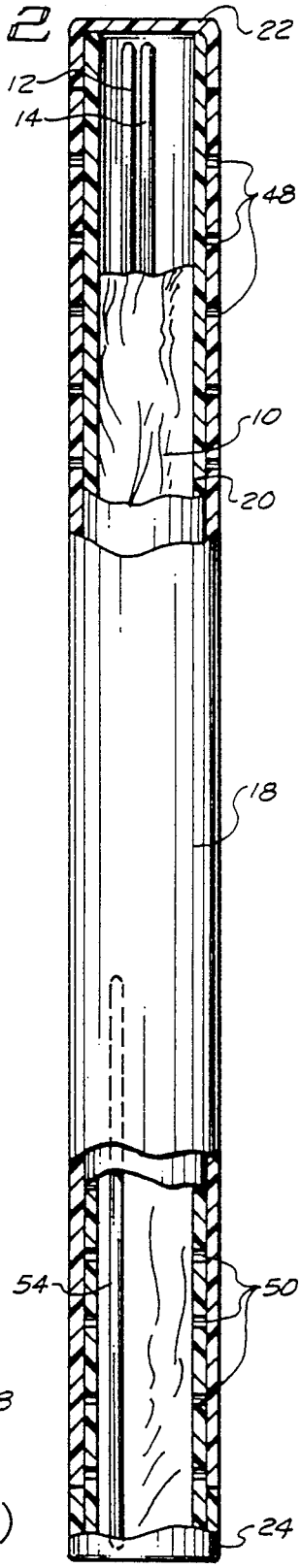
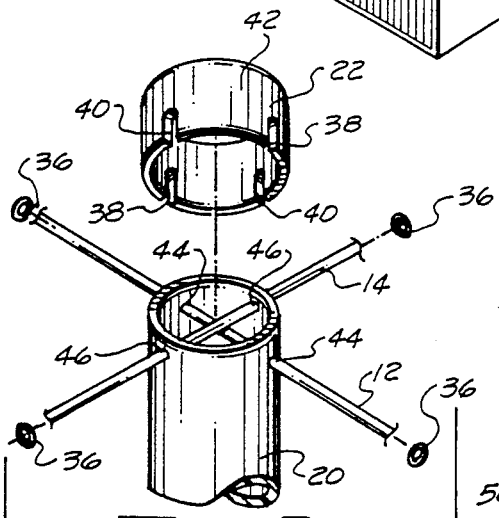
FIG. 3
FIG. 4
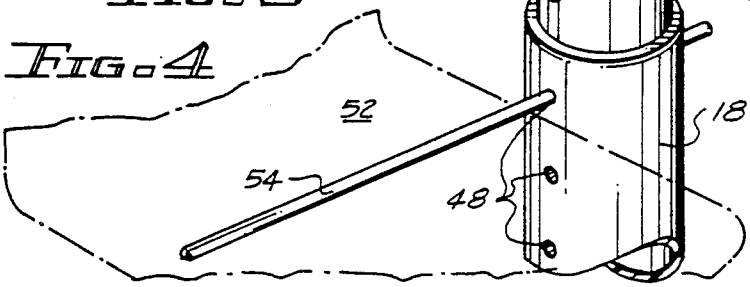

FIG. 10
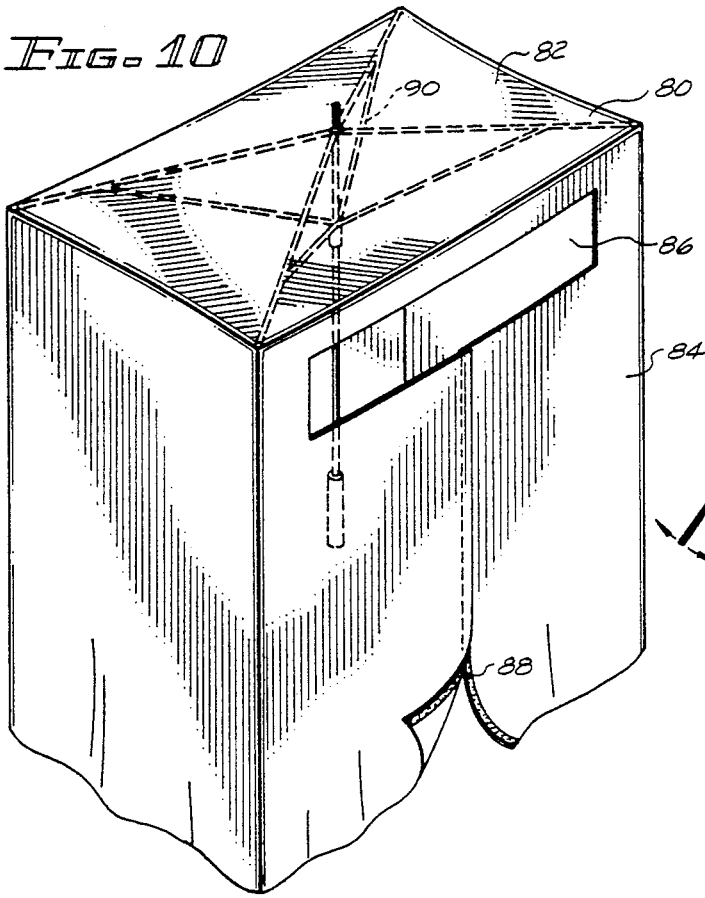
FIG. 11
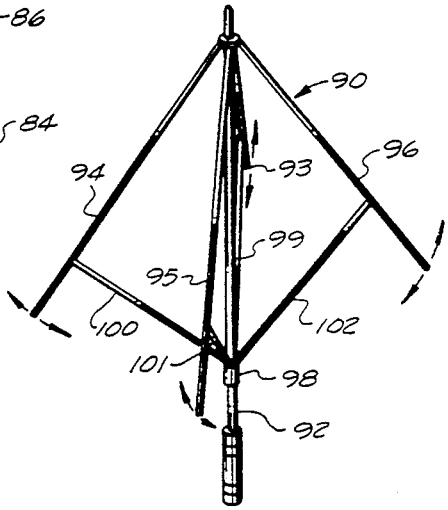
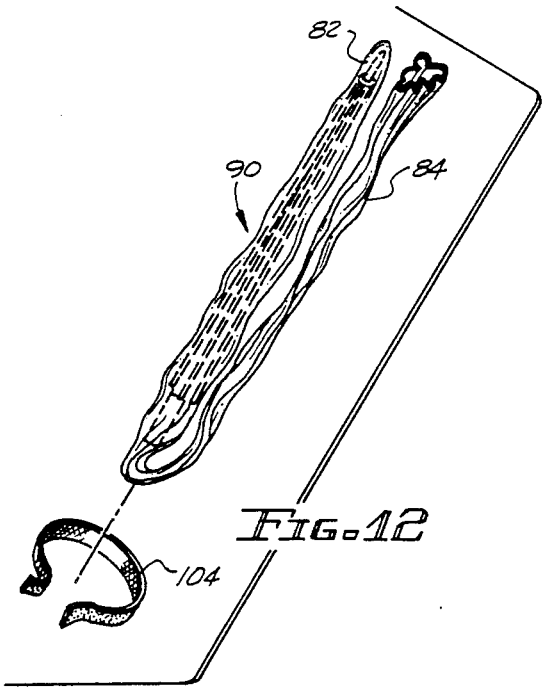
FIG. 12
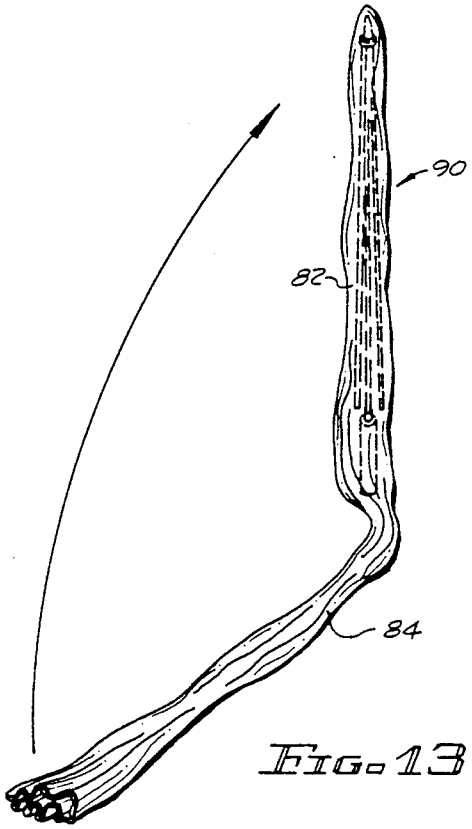
FIG. 13

PORTABLE UMBRELLA SHELTER

This application is a division of application Ser. No. 07/405,200, filed Sep. 11, 1989.

BACKGROUND OF THE INVENTION

This invention relates generally to portable shelters and, more particularly, to a collapsible shelter for use in a stadium or other outdoor scenario to protect its user or users from inclement weather.

Often, spectators at sporting events or other outdoor events are forced to leave their seats from which they can view the event in order to find shelter from rain or the like. Conventional umbrellas, due to their size and shape are not suited for high density seating such as that found in stadiums nor do they afford very much protection As a result of these disadvantages, collapsible shelters have been proposed For example, see U.S. Pat. No. 4,086,931 issued May 2, 1978 and entitled UMBRELLA SHELTER; U.S. Pat. No. 2,024,105 issued Dec. 10, 1935 and entitled UMBRELLA; U.S. Pat. No. 2,863,467 issued Dec. 9, 1958 and entitled COMBINATIONAL SHELTERS; and U.S. Pat. No. 734,311 issued Jul. 21, 1903 and entitled ATTACHMENT FOR UMBRELLAS.

U.S. Pat. No. 4,086,931 describes an umbrella shelter which includes a rectangular umbrella which has its supporting pole positioned on the middle of the back edge so as not to obstruct the space under the umbrella. A vertical sheet of fabric hangs down from the back edge and portions of the side edges of the umbrella. This partial enclosure is completed by a removable front panel having a transparent upper portion and attachment means for connection with the umbrella and forward side edges of the vertical back fabric. The umbrella pole may be mounted on a stadium bench for sports spectators, on a seat for fisherman or duck hunters, etc. Unfortunately, this umbrella shelter, like other prior art arrangements, is not easy to transport or store.

SUMMARY OF THE INVENTION

It is an object of the present invention to provide an improved portable shelter.

It is a further object of the present invention to provide an improved collapsible shelter.

It is a still further object of the present invention to provide an improved collapsible shelter wherein the supporting pole is also a container for the remainder of the shelter when being stored or otherwise not in use.

Yet another object of the present invention is to provide an improved umbrella-type shelter wherein the length of the supporting pole or handle is adjustable to accommodate a user which is standing or sitting.

Accordingly, in a first embodiment of the invention there is provided a portable collapsible shelter comprised of a flexible material having a top and at least one sidewall depending therefrom, at least one frame member for engaging and supporting the top, and a hollow pole member for coupling to and supporting the frame member, the hollow pole member for receiving and storing the flexible material and the frame member when the shelter is being transported or otherwise not in use.

The hollow pole member may be telescopic to vary the height of the shelter, and the top may be rectangular to accommodate stadium type seating Four side walls may be provided to provide a protective enclosure, and a viewing window may be provided in one of the walls.

Caps are provided at both ends of the hollow pole member to form an enclosure for the folded up flexible material and disassembled frame during transport and storage.

In an alternate embodiment of the invention, the shelter comprises a flexible material supported on a conventional umbrella-type frame consisting of a vertical support pole, a plurality of ribs each hinged to one end of the pole, a slide ring carried on the support pole for opening and closing the shelter, and a plurality of strut links connected between the slide ring and the ribs. When the frame is collapsed to a non-use position, the flexible material may be left in place on the frame and doubled over to form a compact storage packet. Fastening means may be provided for securing the flexible material in its folded configuration.

The above and other objects, features, and advantages of the present invention will be more clearly understood from the following detailed description taken in conjunction with the accompanying drawings, in which:

BRIEF DESCRIPTION OF THE DRAWINGS

FIG. 1 is a perspective view of the inventive portable shelter;

FIG. 2 illustrates how the entire shelter of FIG. 1 is stored within the supporting pole or handle;

FIG. 3 illustrates how the crossbars of the FIG. 1 shelter pass through openings in an upper portion of the support pole or handle and how the resulting portion is capped;

FIG. 4 illustrates the telescoping support pole or handle of the shelter shown in FIG. 1;

FIG. 10 illustrates the collapsible frame used with the portable shelter of FIG. 9.

FIG. 11 illustrates the portable shelter of FIG. 9 in its folded configuration and in exploded relationship to a fastening band.

FIGS. 12 and 13 illustrate the portable shelter of FIG. 9 during an intermediate folding steps.

DESCRIPTION OF THE PREFERRED EMBODIMENT

Figure 5:
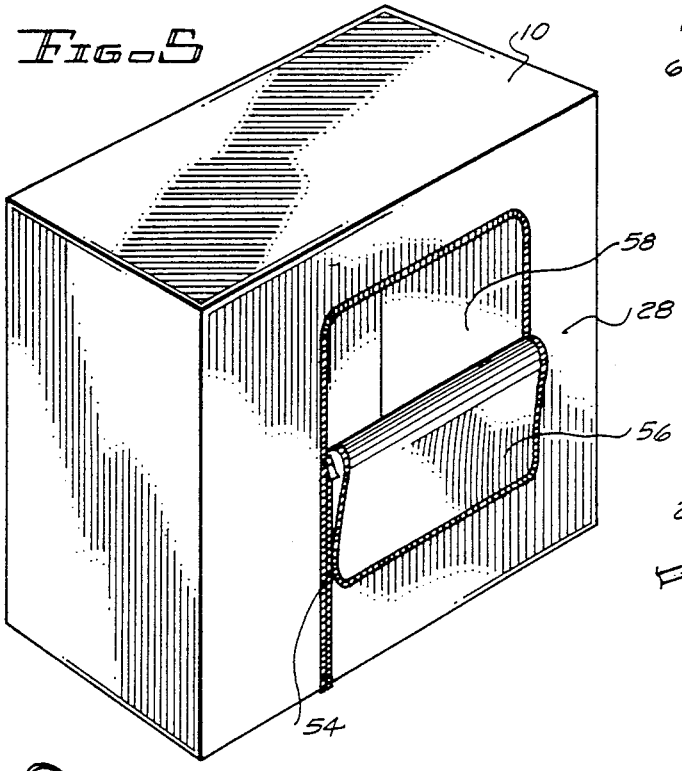
FIG. 5 illustrates an alternate embodiment of the inventive portable shelter.

FIG. 1 illustrates a first embodiment of the inventive collapsible shelter. The shelter comprises an enclosure 10 of flexible material (e.g. plastic, canvas, nylon, etc.) supported by cross-bars 12 and 14 which are in turn supported by a hollow support pole 16. Support pole 16 preferably comprises first and second telescoping members 18 and 20 respectively and is closed at its upper and lower ends by removable caps 22 and 24 respectively.

Enclosure 10 comprises a rectangular top 26 and four sidewalls including a front sidewall 28. As can be seen, front sidewall 28 has a viewing window 30 provided therein and may also include a slit 32 for selectively opening and closing wall 28 to provide entry into and exit from enclosure 10. Slit 32 may be secured by a variety of fastening means; e.g. snaps, zipper, or as shown, a Velcro® strip 34.

Figure 8:
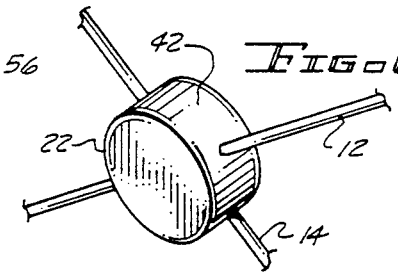
FIG. 8 illustrates an alternate cap in the embodiment shown in FIG. 6.

Referring to FIG. 3, it can be seen that the upper portion of inner telescoping member 20 is provided with two pairs of aligned holes 44 and 46 through which cross-bars 12 and 14 respectively can pass. The ends of cross-bars 12 and 14 are received by receiving rings 36 which are coupled to the top portion of enclosure 10 at the corners. Cap 22 is provided with first and second pairs of grooves 38 and 40 which capture cross-bars 12 and 14 respectively when cap 22 is placed over the upper end of telescoping member 20. Alternately, grooves 38 and 40 may be replaced with aligned holes as shown in FIG. 8. In this case, it would be necessary to place cap 22 over the end of member 20 prior to insertion of cross-bars 12 and 14.

Telescoping members 18 and 20 are each provided with a plurality of aligned holes 48 and 50 respectively. To adjust the height of the shelter, the lower end of outer telescoping member 18 is placed on a support surface (e.g. stadium seat 52). Inner telescoping member 20 is then lifted out of outer member 18 until a desired height is achieved. When a desired height is reached, a retaining rod 54 is inserted through aligned holes in members 18 and 20 to fix the height of the shelter.

The inventive collapsible shelter is capable of easy storage and transport as shown in FIG. 2. That is, when not in use, the folded flexible enclosure 10, cross-bars 12 and 14 and retaining rod 54 fit within inner telescoping member 20 which has been inserted into outer member 18. Upper and lower caps 22 and 24 respectively complete the cylindrical canister.

Disassembly of the shelter is extremely simple. First, the flexible enclosure 10 is removed followed by removal of cross-bars 12 and 14. Next, retaining rod 54 is removed, and inner member 18 inserted into outer member 18. Cross-bars 12 and 14 and retaining rod 54 are placed inside hollow member 18. Flexible enclosure 10 is folded and likewise placed inside hollow member 18 Cap 22 is then placed over the open end of member 20 and abuts outer member 18 to complete the storage/-transport container. Assembly of the inventive shelter requires a mere reversal of this process.

FIG. 5 illustrates an alternate embodiment of the present invention. In this case, a single zipper 54 provides for entry to and exit from the shelter and also secures a flap 56 which, when open, forms a viewing window 58 Flap 56 may be transparent.

Figure 6:
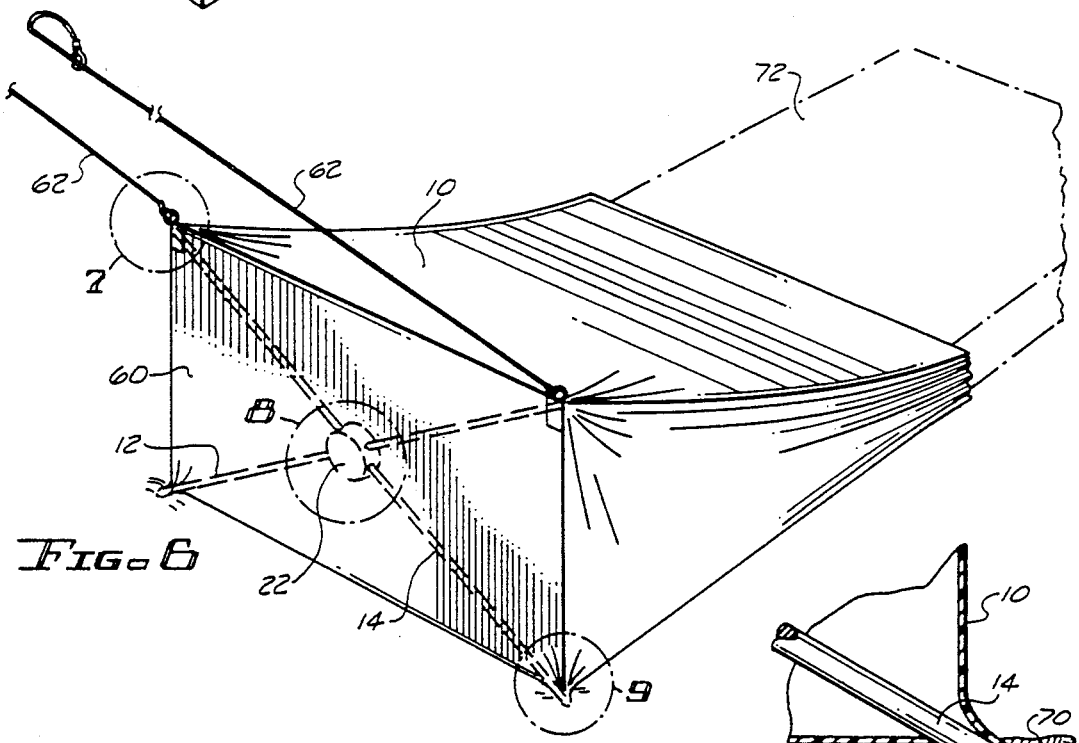
FIG. 6 illustrates yet an additional embodiment of the present invention.

FIG. 6 illustrates how the inventive collapsible shelter may be converted into an outdoor sleeping shelter In this case, hollow support member 16 is dispensed with, and the flexible enclosure 10 is positioned on its side (i.e. horizontally). What was top 26 now becomes a generally vertical sidewall 60 which is urged into its rectangular shape by cap 22 and cross-bars 12 and 14 as previously described.

Figure 7:
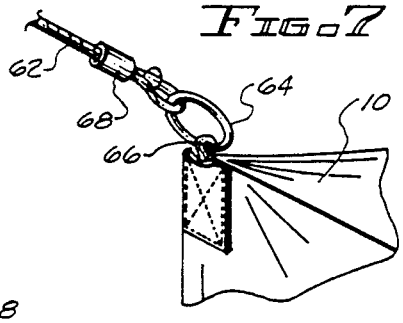
FIG. 7 illustrates the attachment means utilized in the embodiment shown in FIG. 6.

The upper corners of wall 60 are secured to a nearby structure or trees (not shown) by means of lines 62. That is, a ring 64 is secured to a loop 66 at each of the upper corners of wall 60 as is shown in FIG. 7. A fastener 86 attached to line 62 is then coupled to ring 64.

Figure 9:
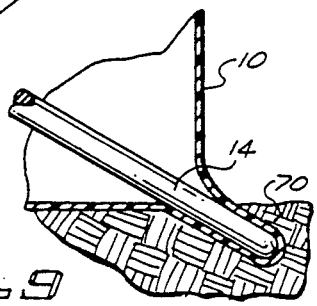
FIG. 9 is a perspective view showing an alternative embodiment of the portable shelter.

The lower ends of cross bars 12 and 14 and the adjacent flexible material are forced into the ground 70 as is shown in FIG. 9. With wall 60 secured, one end of an air mattress and/or sleeping bag 72 may be inserted into the shelter as shown in FIG. 6. Thus there has been proved an improved collapsible shelter which may be used in high density seating environments such as stadiums or in remote areas for camping or the like. The shelter is extremely simple to assemble and disassemble. It is completely self contained and, as such, is easy to transport and store.

In an alternative embodiment of the invention, illustrated in FIG. 10, the enclosure 80 is again formed of flexible material and comprises a rectangular top 82 and a sidewall 84, which may consist of four individual walls stitched together at the sides, or a single continuous wall extending entirely around the enclosure. The sidewall 84 includes viewing window 86 and entry slit 88.

Enclosure 80 is supported on a collapsible frame 90, which is best illustrated in FIG. 11. The frame 90 comprises a vertical support pole 92, which may optionally consist of a pair of telescoping members (not shown) to allow the height of enclosure 80 to be varied. Four ribs 93, 94, 95, 96 are hinged to the pole 92 near the top thereof. The free end of each rib supports one of the four corners of rectangular top 82 when the shelter is in use. A slide ring 98 is carried on support pole 92, and four strut links 99, 100, 101, 102 are connected between the slide ring 98 and ribs 93, 94, 95, 96. Like a conventional umbrella, the enclosure 80 is opened by raising slide ring 98, causing strut links 99, 100, 101 and 102 to push ribs 93, 94, 95 and 96 into a nearly horizontal position, and closed by lowering slide ring 98, causing the strut links 99, 100, 101 and 102 to pull ribs 93, 94, 95 and 96 into a collapsed position alongside pole 92.

After slide ring 98 has been lowered and ribs 93, 94, 95 and 96 have been moved into the collapsed position, the sidewall 84 of enclosure 80 hangs loosely below the bottom end of pole 92, as shown in FIG. 13. The bottom edges of the sidewall 84 can then be gathered, and the enclosure 90 doubled upon itself as shown on FIG. 12. Once folded, the sidewall 84 may be secured against the top 82 by means of fastening band 104, the opposite ends of which are detachably coupled to one another by means of Velcro® or the like. Thus, the collapsed shelter forms a compact, convenient packet which is easy to transport and store.

The above description is given by way of example only. Changes in form and detailed may be made by one skilled in the art without departing from the scope of the invention as defined by appended claims.

I claim:

1. A portable collapsible shelter, comprising:

a flexible material having a rectangular top and a first, second, third and fourth sidewall extending downward in a free-hanging relationship therefrom, to form an enclosure;

a first cross-bar and a second cross-bar, each having ends engaging diagonally opposite corners of said rectangular top;

a hollow pole member having first and second pairs of aligned holes proximate to and extending through an upper end thereof for receiving and supporting said first and second cross-bars, said hollow pole member for receiving and storing said flexible material and said first and second cross-bars when said shelter is not in use.

2. A shelter according to claim 1, further comprising a first cap for enclosing the upper end of said hollow pole member.

3. A shelter according to claim 2, wherein said first cap has a cylindrical side wall.

4. A shelter according to claim 3, wherein said sidewall has a plurality of openings therein to accommodate said cross-bars.

5. A shelter according to claim 4, wherein said plurality of openings are grooves.

6. A shelter according to claim 4, wherein said plurality of openings are holes.

7. A shelter according to claim 1, further comprising a second cap for enclosing a lower end of said hollow pole member.

8. A shelter according to claim 4, wherein said hollow pole member is cylindrical.

9. A shelter according to claim 1, wherein said hollow pole member is a variable length hollow pole.

10. A shelter according to claim 9, wherein said variable length hollow pole comprises at least first and second telescoping members.

11. A shelter according to claim 10, wherein said first and second telescoping members are provided with a plurality of aligned openings therein and further comprising a retaining rod for insertion into at least one pair of said aligned holes to fix the length of said pole..

* * * * *